US006688473B2

(12) United States Patent
Franzreb et al.

(10) Patent No.: US 6,688,473 B2
(45) Date of Patent: Feb. 10, 2004

(54) HIGH GRADIENT MAGNETIC SEPARATOR

(75) Inventors: Matthias Franzreb, Karlsruhe (DE); Wolfgang Höll, Ettlingen (DE); Christian Hoffmann, Waghäusel (DE)

(73) Assignee: Forschungszentrum Karlsruhe GmbH, Karlsruhen (DE)

( * ) Notice: Subject to any disclaimer, the term of this patent is extended or adjusted under 35 U.S.C. 154(b) by 192 days.

(21) Appl. No.: 10/056,799

(22) Filed: Jan. 18, 2002

(65) Prior Publication Data

US 2002/0088741 A1 Jul. 11, 2002

Related U.S. Application Data

(63) Continuation-in-part of application No. PCT/EP00/06498, filed on Jul. 8, 2000.

(30) Foreign Application Priority Data

Jul. 22, 1999 (DE) ..... 199 34 427

(51) Int. Cl.[7] ..... B03C 1/30
(52) U.S. Cl. ..... 209/39; 209/232
(58) Field of Search ..... 209/232, 213, 209/214, 212, 223.1, 228, 225, 39; 210/222

(56) References Cited

U.S. PATENT DOCUMENTS 4,941,969 A 7/1990 Schönert et al.

FOREIGN PATENT DOCUMENTS

GB 2 163 676 3/1986

*Primary Examiner*—Kenneth W. Noland
(74) *Attorney, Agent, or Firm*—Klaus J. Bach

(57) ABSTRACT

In a high gradient magnetic separator with a separation zone consisting of a matrix of parallel magnetic wires arranged in parallel planes and channels formed by a non-magnetic material and extending in each plane between adjacent parallel magnetic wires for conducting a fluid including magnetic particles through the matrix, and a magnetizing structure disposed adjacent the matrix for generating a magnetic field with field lines which extend essentially normal to the parallel planes, separating walls are disposed in parts of the channels in the area ahead of the end of the magnetic field generated in the matrix and adjacent the flow exit end of the matrix so as to extend parallel to the planes and normal to the magnetic field lines and form partial flow channels receiving partial fluid flows of magnetic particle-enriched and, respectively, magnetic particle-depleted flow volumes.

9 Claims, 7 Drawing Sheets

Section D

HIGH GRADIENT MAGNETIC SEPARATOR

This is a Continuation-In-Part application of international application PCT/EP00/06498 filed Jul. 8, 2000 and claiming the priority of German application No. 199 34 427.2 filed Jul. 22, 1999.

BACKGROUND OF THE INVENTION

The invention relates to a high gradient magnetic separator comprising a matrix of parallel wires which can be magnetized and are arranged in planes each of which includes a channel with a non-magnetic wall, which extends between two parallel wires and through which fluid including magnetic particles can be conducted, and an arrangement for generating in the matrix a magnetic field which extends normal to the planes which are defined by the wires and channels.

A general overview concerning the various types of magnetic operators as well as their applications is presented in the reference [1]. In accordance therewith coarse, highly magnetic particles such as magnetite ores with a particle size >75 $\mu$m and highly magnetic finer particles can be separated from aqueous suspensions up to a size of about 10–20 $\mu$m with simple drum or belt separators. For still finer particles in the micrometer range, so far only the so-called high gradient magnet separation is used whose principle of separation is based on the generation of strong field strength gradients by introduction of a ferromagnetic matrix structure into an outer magnetic field. The matrix structure generally consists of irregularly arranged steel wool or, respectively, systematic wire nets or profiled metal plates. The elements of the matrix structure are magnetized by the outer field and form magnetic poles, which locally strengthen or weaken the outer field. This provides for high field strength gradients resulting in a strong magnetic force on para- or, respectively, ferromagnetic particles in the direction of the greater field strength. The particles attach themselves to the induced magnetic poles of the matrix and consequently are separated from the fluid.

[2] discloses another high gradient magnetic separator for the continuous separation of particles from a fluid flow including magnetic particles (in the example given: ore suspensions) into partial fluid flows each enriched with non-magnetic and, respectively, magnetic particles. With this high-gradient magnetic separator, the previously prepared particle-containing fluid is conducted into a non-magnetic tube. The tube extends into the separation zone in which magnetic wires are arranged in parallel at uniform distances from one another to form a matrix structure. With the application of an outer magnetic field, which can be generated by a permanent magnet, an electromagnet, a super-conductive magnet or a cryo-technical magnet, the wires are magnetized whereby a field of magnetic force gradients is formed around the wires. Consequently, the magnetic particles in the fluid flow are concentrated in this field in the areas of the highest magnetic field strength, that is, directly at the magnetic poles or wires. As a result, during continuous operation, the separator will be clogged by particles collected on the magnetic poles of the wires. Directly following the separation zone, the fluid is directed, shortly before leaving the outer magnetic field, into a channel structure whose inlets are so arranged that the fluid flow is divided and exits the arrangement in a flow enriched with magnetic particles and a depleted flow.

An apparatus for a continuous magnetic separation capability with substantially lower clogging tendency during continuous operation is disclosed in [3]. Important herein is that the separation zone, which has an elongated cross-section and into which the magnetic particle-containing fluid is conducted has a non-magnetic wall. To the separator, a magnetic field is applied whose field lines extend in the separation zone ideally normal to the flow direction of the fluid and normal to the longest axis of symmetry of the flow cross-section. In order to generate the magnetic field gradients necessary for the magnetic separation of ferro-, para-, and diamagnetic particles, a single magnetizable wire is arranged at a front end of the elongated cross-section of the separation zone parallel to the flow direction of the fluid. Still under the influence of the magnetic field, the separation zone is divided into several channels which separate the fluid into different fractions, which differ by the content of magnetic particles. The apparatus is also described in [4] wherein an additional embodiment is disclosed which includes two magnetizable wires (instead of a single wire) each extending at the front ends of the elongated cross-section of the separation zone parallel to the flow direction. The apparatus however, by its design as described, has to have a certain size which limits its applicability particularly for larger fluid flows.

A high gradient magnetic separator of the type referred to initially with a very compact matrix-shaped cross-section arrangement of the separation zone which is suitable also for larger fluid flows as they actually occur, is described in [5]. It is provided with magnetizable wires which are arranged alternately with rectangular channels which are disposed parallel to the wires in a line-like fashion, wherein the individual lines are separated from one another by paramagnetic intermediate plates. For the separating procedure, a magnetic field is applied in a direction normal to the lines and the intermediate plates. However, no actual examination of the concept is described in [5] nor is any technical solution disclosed for the supply and the removal of the fluid to be separated.

It is the object of the present invention to provide a high gradient magnetic separator with channels in the area of the separation zone in such a way that the efficiency of the apparatus is increased over those known in the state of the art. Furthermore, a discharge flow arrangement is to be provided which is accurately adapted to the partial flows of the fluid being separated.

SUMMARY OF THE INVENTION

In a high gradient magnetic separator with a separation zone consisting of a matrix of parallel magnetic wires arranged in parallel planes and channels formed by a non-magnetic material and extending in each plane between adjacent parallel magnetic wires for conducting a fluid including magnetic particles through the matrix, and a magnetizing structure disposed adjacent the matrix for generating a magnetic field with field lines which extend essentially normal to the parallel planes, separating walls are disposed in parts of the channels in the area ahead of the end of the magnetic field generated in the matrix and adjacent the flow exit end of the matrix so as to extend parallel to the planes and normal to the magnetic field lines and form partial flow channels receiving partial fluid flows of magnetic particle-enriched and, respectively, magnetic particle-depleted flow volumes.

In the area of magnetic field gradients freely movable magnetic particles, which are suspended in a solution, will basically collect in the area of the highest magnetic strength. In this respect, not only the magnetic forces components which are oriented radially to the magnetizable wires, are acting on these particles but also the magnetic forces components extending tangentially to the wires. These tangential magnetic force components have been taken into consideration in the design considerations for the channel cross-sections in the separation zone of the high gradient magnetic separator according to the invention. The arrangement according to the invention results in the generation of magnetic force gradients with radial and tangential orientations in the flow cross-section in such a manner that the magnetic particles contained in the fluid flow can be concentrated during the passage through the separation zone as completely as possible in a small partial fluid flow. Consequently, the high gradient magnetic separator according to the invention has—in contrast to the prior art arrangement last mentioned—an elliptical or circular cross-section for the channels in the separation zone.

The magnetic particles are enriched in flow direction in the separation zone in segments of the elliptical or circular channels, which are turned by 90° with respect to the row structure. Still within the separation zone, that is, within the magnetic field, separating walls are disposed within the channels which extend parallel to the row structure and which divide the flow into partial flows with, and without, magnetic particles.

An embodiment of the invention will be described below in greater detail on the basis of the accompanying drawings.

DESCRIPTION OF A PREFERRED EMBODIMENT

Figure 1:
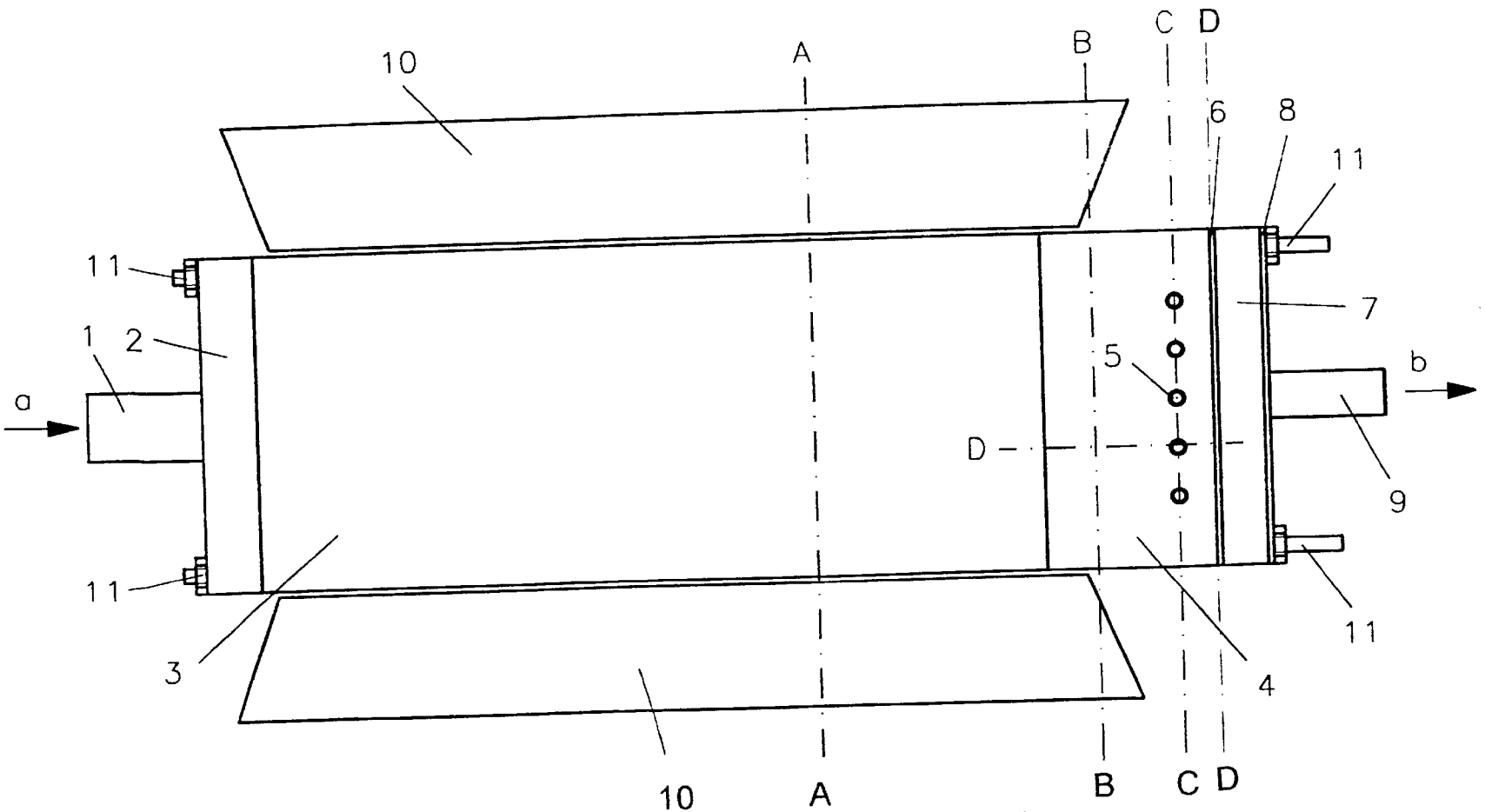
FIG. 1 is a schematic side view of the high gradient magnetic separator with an inlet, a separation zone shown as a separator block, separate outlets for the two fluid fractions and a magnetizing arrangement.

FIG. 1 shows an arrangement including all the components of the high gradient magnetic separator according to the invention. The arrangement includes an inlet 1 and a distributor 2 through which the fluid flow a reaches a separation zone, which is disposed in the separation block 3. The separation of the fluid flow a ideally into a partial flow b with magnetic particles and a partial flow c without magnetic particles occurs in the so-called splitting block 4 which also includes the fluid outlet 5 for the partial fluid flow c (without magnetic particles). The partial fluid flow b (with magnetic particles) passes through the splitting plate 6 to a collector 7, which is delimited by the end plate 8 and from which the outlet 9 for the partial fluid flow b extends. The separator block 3, as well as part of the splitting block 4, are disposed between the poles 10 of a permanent magnet system which generates a magnetic field H in those areas. The components of the high gradient magnetic separator are tightly joined in the embodiments shown in FIG. 1 by a clamping structure 11 (for example, by threaded rods with clamping nuts) and sealed. FIG. 1 further more shows the lines A—A, B—B , C—C, and D—D which represent the locations where the cross-sections of FIGS. 2 to 5are taken through the magnetic separator.

Figure 2:
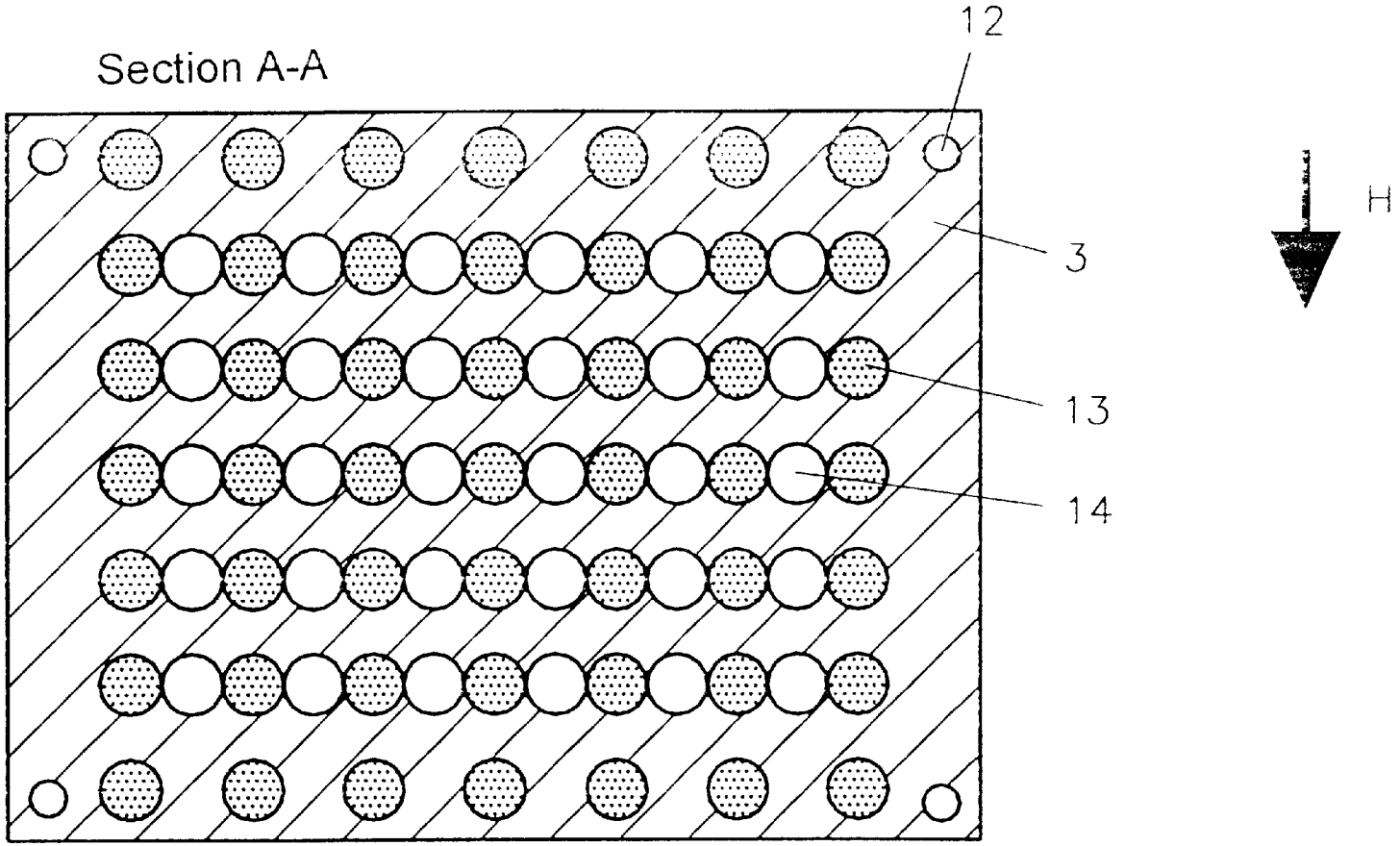
FIG. 2 is a cross-sectional view of the separator block in a plane extending normal to the ferromagnetic wires and the flow channels.

The section through the separator block 3 along the plane A—A of FIG. 1 is shown in FIG. 2. The separator block 3 consists of a non-magnetic material and includes bores, which extend through the separator block 3 in a matrix-like arrangement in several parallel rows which extend normal to the cross-sectional plane. The bores include ferromagnetic wires 13. With the exception of the first and the last row, each row includes a flow passage 14 of circular cross-section, which extends through the whole separator block 3 between every two sets of parallel wires 13, wherein the flow passages 14 and the wires 13 are separated from each other by the non-magnetic material of the separator block 3. The direction of the magnetic field H (arrow in FIG. 2) required during the continuous operation is normal to the planes, which are defined by the sets of ferromagnetic wires 13 and the channels 14 arranged in rows. FIG. 2 also shows the bores 12 in the separator block 3 through which the clamping bolts 11 extend.

With the arrangement of the wires 13 and the channels 14 in the outer magnetic field H, the areas in which the magnetic particles collect and in which they are concentrated, that is the area where the repulsive magnetic forces are small, is disposed turned by 90° relative to the contact points of each channel 13 with the wire 14. With the arrangement of channels 14 and wires 13 relative to each other in the magnetic field H as described the chances of a clogging of the channels 14 by particle deposits are substantially prevented during continuous operation.

Figure 3:
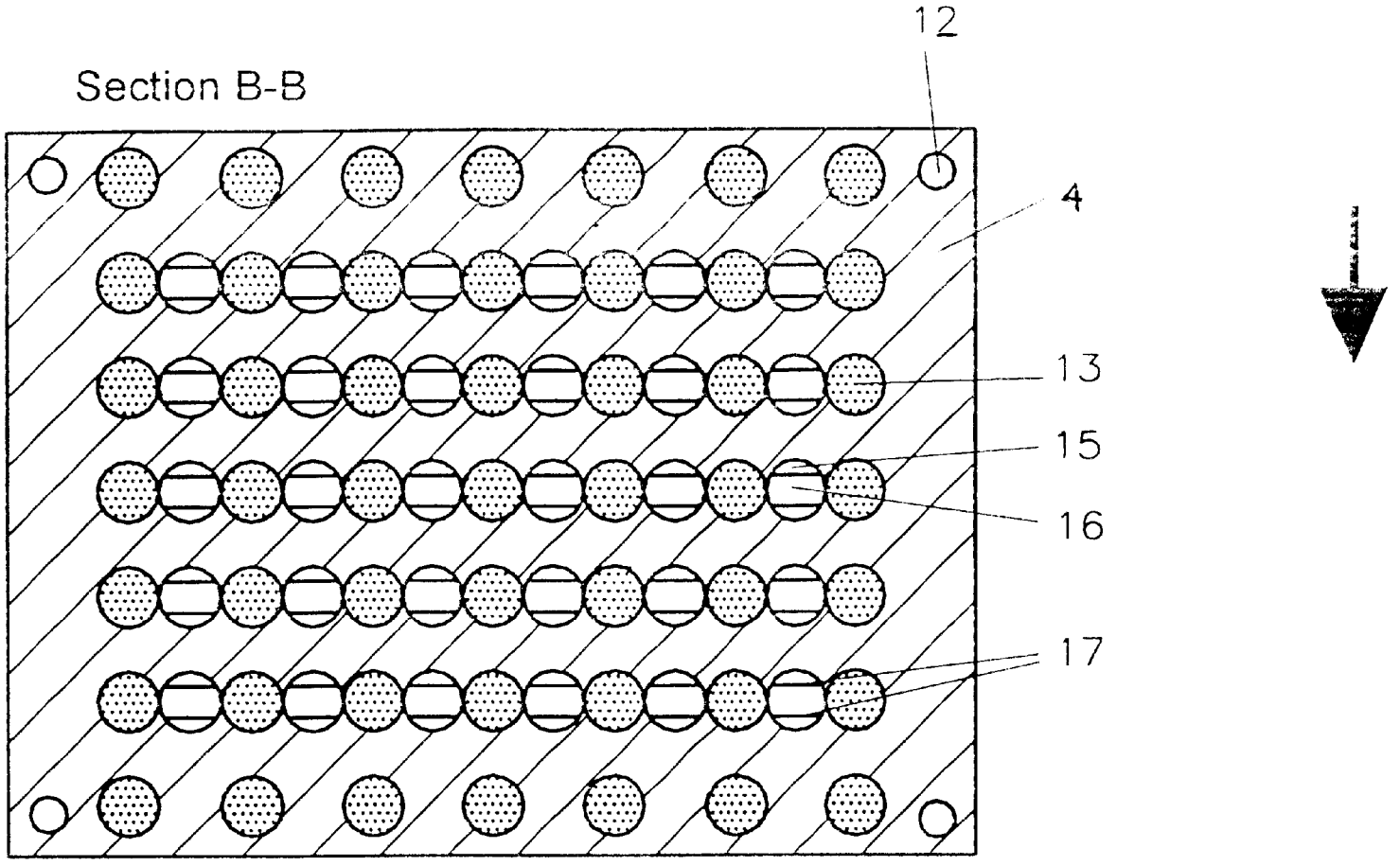
FIG. 3 is a cross-sectional view of the splitting block near the separation block (that is still under the influence of the magnetic field) normal to the ferromagnetic wires and the flow channels which, in this area, already include the flow dividing separation walls.

FIG. 3 shows the splitting block 4 in a cross-sectional view taken along line B—B of FIG. 1, that is, immediately adjacent the separator block 3 in an area which is still under the influence of the magnetic field H. Consequently, the cross-section of the splitting block 4 corresponds in this area to a large extent to that of the separator block 3. It is different in that the channels 14 for dividing the fluid flow a into the two partial fluid flows b and c are divided by two separating walls 17, which extend normal to the magnetic field H, into a center channel 16 and two side channels 15. While the larger fluid flow c, which is depleted of the magnetic particles is conducted to the outlet 5 by way of the center channel 16 the partial fluid flow b, which is enriched with the magnetic particles and whose volume flow is in the present embodiment about 5 to 30% of that of the partial fluid flow a, flows through the side channels 15 through the splitter plate 6 into the collector 7. The wires 13, which extend through the separator 3 terminate about in the center of the splitting block 4, that is, already outside the magnetic field H. Accordingly, the bores in which the wires extend are provided in the splitting block 4 in the form of blind bores, which extend only to a corresponding depth.

Figure 4:
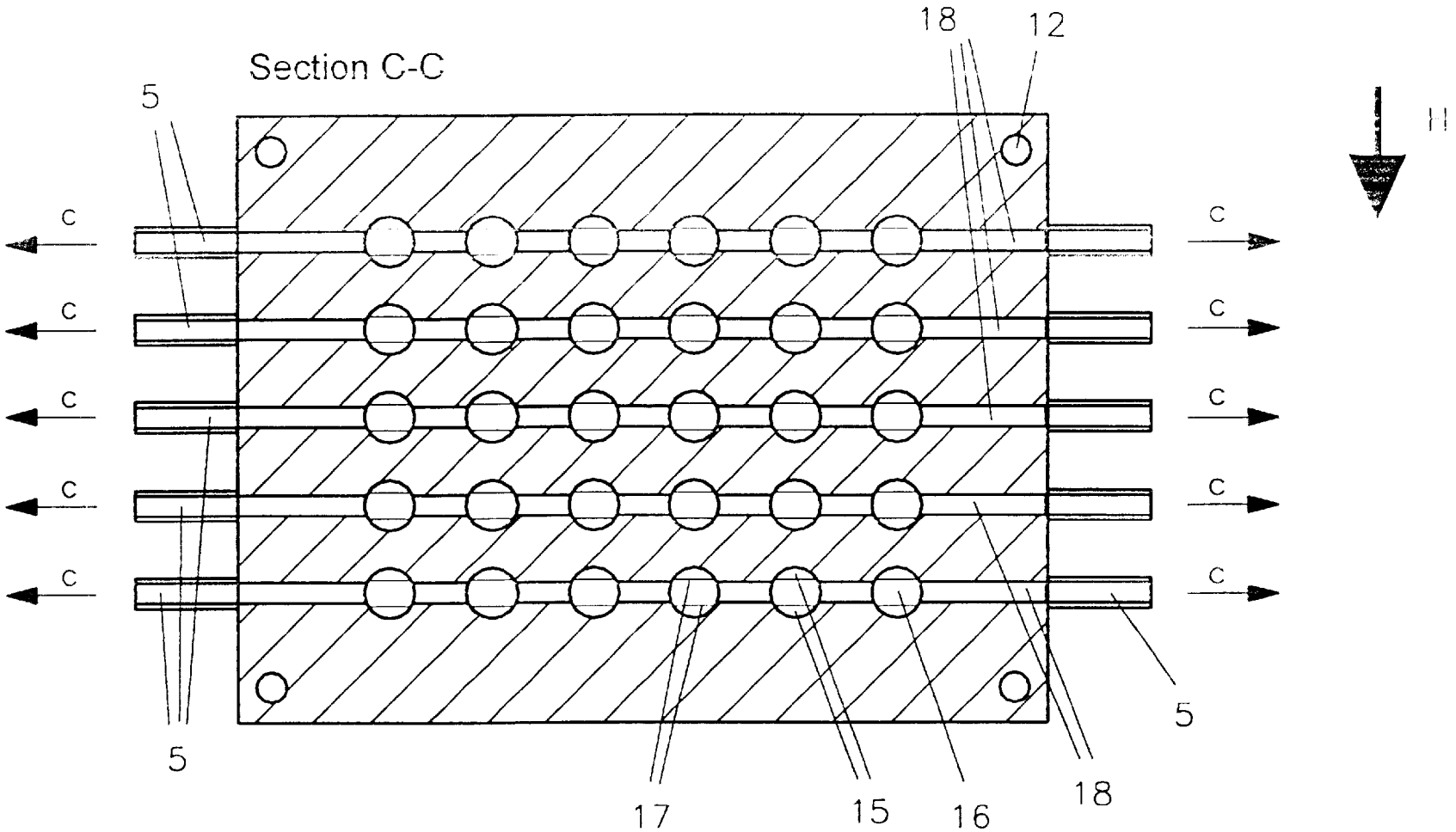
FIG. 4 is a cross-sectional view of the splitting block where the discharge bores for the fluid flow depleted of magnetic particles are disposed.

The cross-section of the splitting block 4 at the outlets 5 along the line C—C of FIG. 1, which his outside the magnetic field H, is shown in FIG. 4. In this area, the fluid flow c, which has been depleted of magnetic particles, is conducted out of the center channels 16 through the collection channels 18, which are in the form of side bores, and is discharged from the high gradient magnetic separator through the outlets 5. The partial fluid flows b, which include the magnetic particles, are conducted out of the splitting block 4 by way of the side channels 15. While the center channels 16 end in the area between the collection channels 18 and the transition to a splitting plate 6 or at the splitting plate, the side channels 15 extend through the hole splitting block 4.

Figure 5:
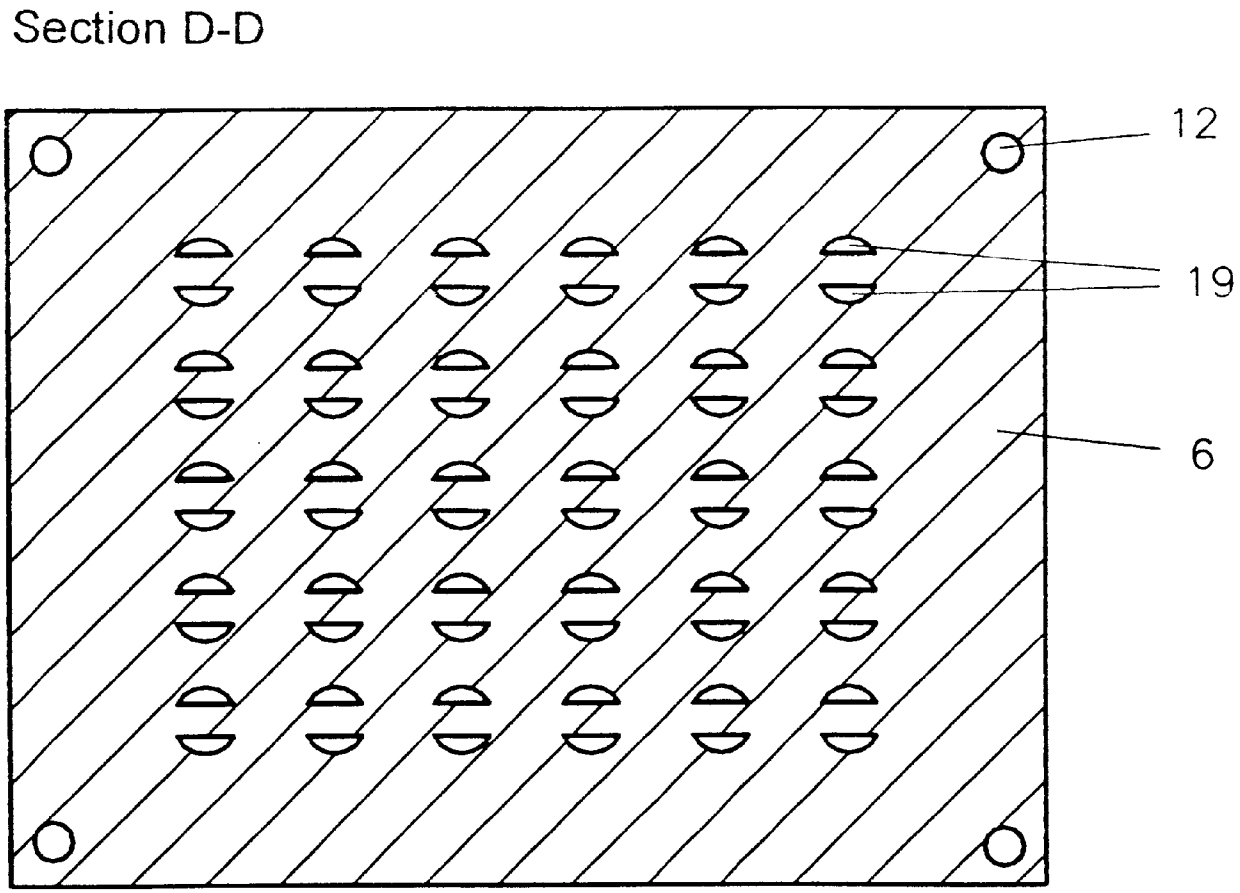
FIG. 5 is a cross-sectional view of the splitting plate.

The splitting block 4 is covered by the splitting plate 6 (see FIG. 5). At the side where the side channels 15 end, the splitting plate 6 includes slot-like openings 19, through which the partial fluid flow b can flow from the side channels 15 into the collector 7. From the collector 7, the partial fluid flow b leaves the high gradient magnetic separator by way of the outlet 9. The center channels 16 are sealingly closed by the splitting plate 6.

Figure 6:
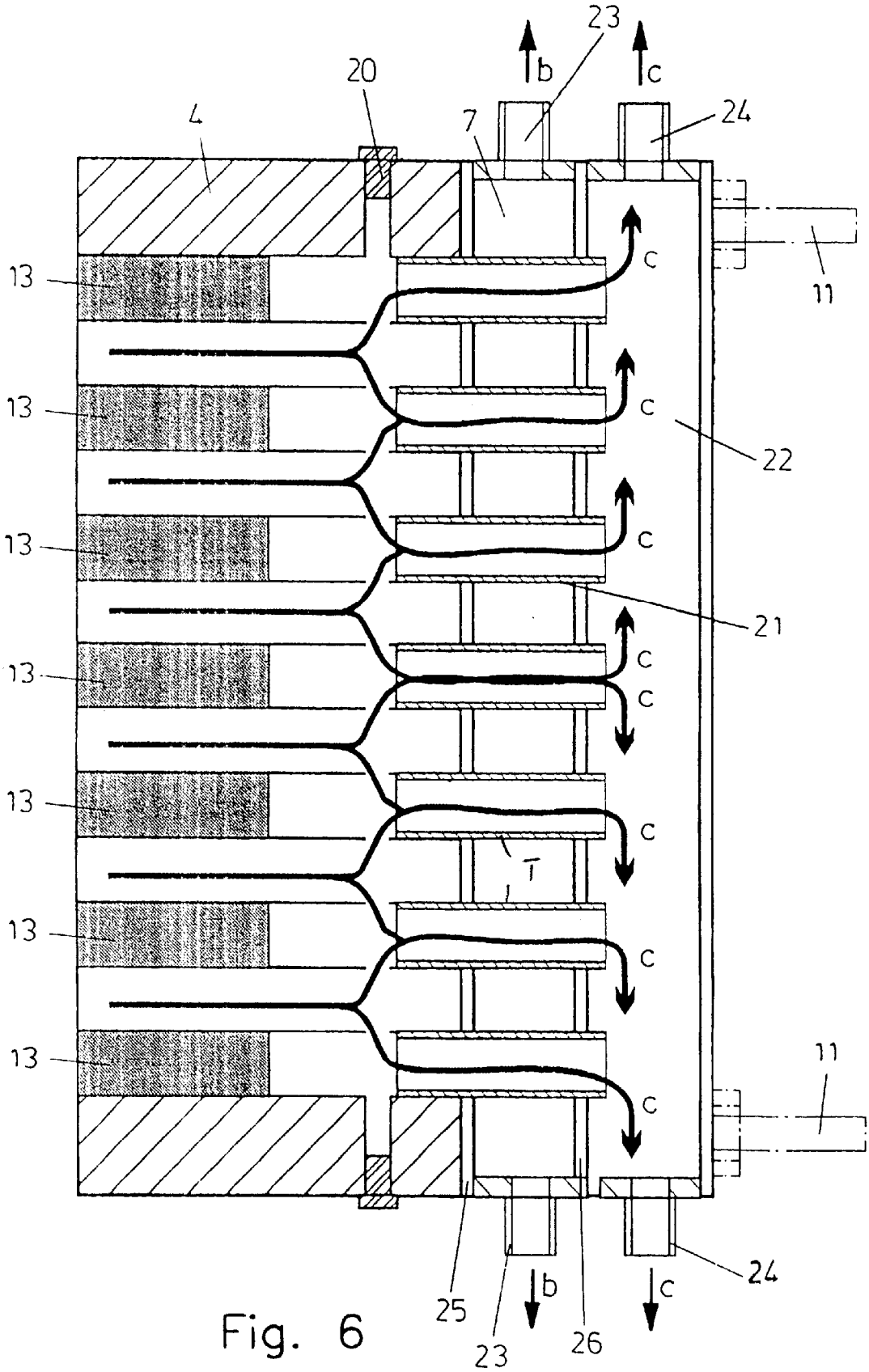
FIG. 6 shows an alternative arrangement for the separated outlets for the individual fluid flows.

FIG. 6 shows an alternative embodiment of the splitting block 4 with the subsequent components for the removal of the partial fluid flows b and c. The splitting block design differs from the embodiment described earlier in that the collection channels 18 (FIG. 4) at the exit end of the splitting block are closed by plugs 20 and the partial fluid flow c, which is depleted of magnetic particles is first conducted from the center passages 16 through the collection channels to connecting tubes T, which are inserted into the bores which accommodate the ferromagnetic wires 13 and which extend through the whole splitting block 4. They bridge the splitting plate 25, which is adapted in its design, as well as the collector 7 and the plate 26 and lead to a solution collector 22 arranged adjacent the collector 7. With the discharge of the partial fluid flow c by way of the solution collection space 22 instead of the collection channels 18 of the embodiment shown in FIG. 4, it is ensured that identical flow and pressure conditions are established in all parallel flow channels 14. In this way, the possibility of optimizing the design and the operation of the high gradient magnetic separator is substantially enhanced. Design conditions require an arrangement of the outlets 23 for the partial fluid flows b out of the collector 7 at the side of the apparatus.

Figure 7A:
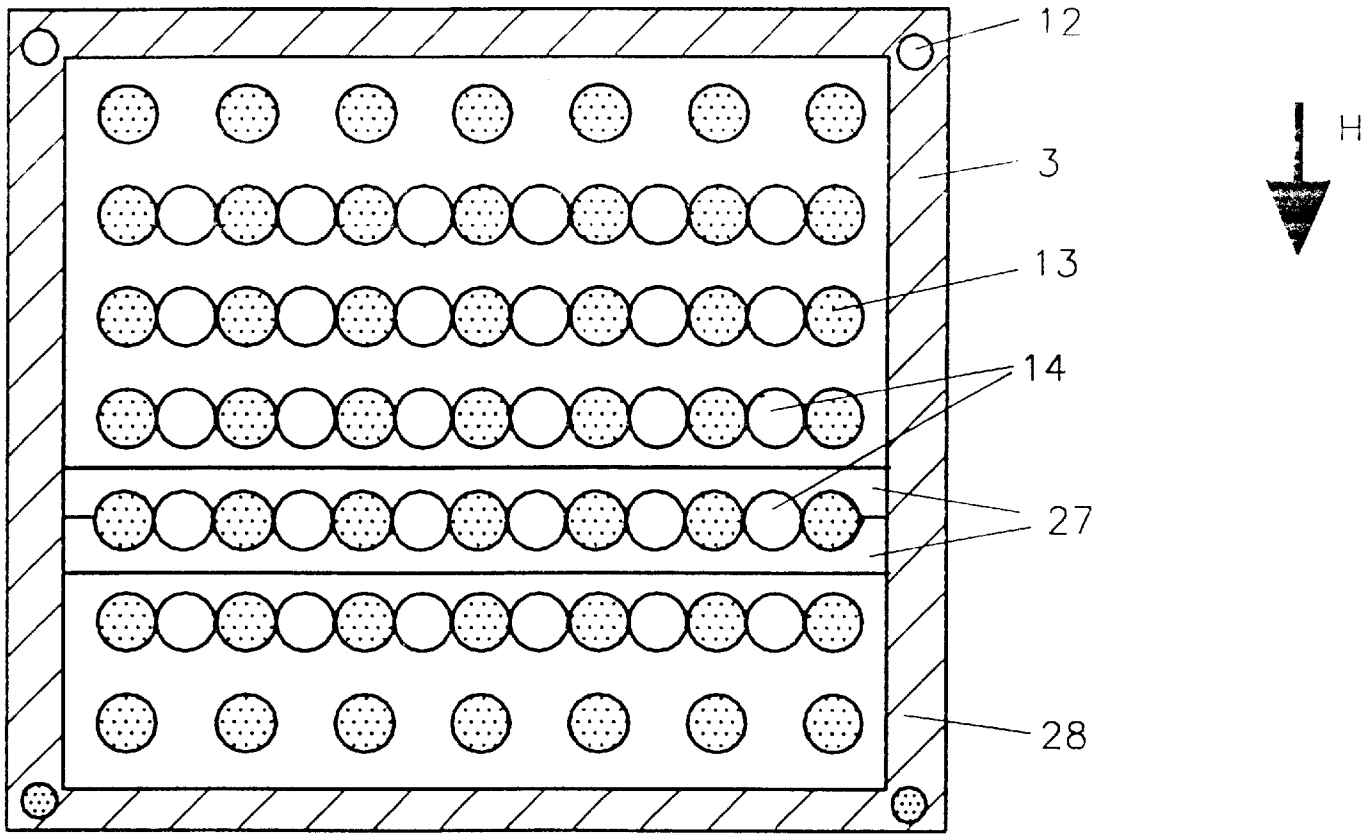
FIGS. 7*a* and 7*b* show an alternative embodiment of a separator block, which consists of form elements taken along a cross-sectional plane extending normal to the ferromagnetic wires and the flow channels.
Figure 7B:
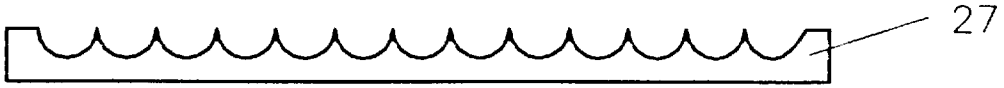

FIG. 7*a* shows schematically an alternative embodiment of the separator block 3. It includes a non-magnetic housing 28, which contains a stack of molded elements 27 (FIG. 7*b*) which are guide elements for the ferro-magnetic wires 13. In this case, the channels 14 of the separator block 3 are formed into the molded elements 27 as recesses. The molded elements 27 are so designed that the matrix around each row consisting of ferro-magnetic wires 13 and channels 14 can be established by two molded elements 27, which are turned by 180° with respect to each other. The arrangement within the stack provides for a space filling of the matrix with non-magnetic material which, in principle, corresponds to that of the monolithic embodiment according to FIG. 2, but which consists of components which are sustantially easier to manufacture.

Literature

[1] J. Svoboda: Magnetic for the Treatment of Minerals, El-sevier Science Publishers, Amsterdam 1987, 325ff

[2] U.S. Pat. No. 4,261,815

[3] U.S. Pat. No. 4,663,029

[4] M. Takayasu, E. Maxwell, D. R. Kelland: Continuous Selective HGMS in the Repulsive Force Mode, IEEE Trans. Magn. MAG-20 (1983) 1186–1188

[5] C. deLatour, G. Schmitz, E. Maxwell, D. Kelland: Designing HGMS Matrix Arrays for Selective Filtration, IEEE Trans. Magn. MAG-19 (1983) 2127–2129.

What is claimed is:

1. A high gradient magnetic separator including a separation zone comprising: a matrix of sets of parallel magnetic wires arranged in rows of parallel planes with a channel extending in each row between adjacent sets of parallel wires and having non-magnetic walls for conducting a fluid including magnetic particles through said matrix in parallel with said matrix of wires, a magnetizing structure disposed adjacent said matrix for generating a magnetic field with field lines extending essentially normal to said parallel planes formed by said sets of wires and channels arranged in said rows, and separating walls disposed in parts of said channels ahead of an end area of the magnetic field generated in said matrix adjacent the flow exit area of said channels from said matrix, said separating walls extending parallel to said planes and normal to said magnetic field lines and forming partial flow channels for receiving partial fluid flows with magnetic particle-enriched flow volumes and, respectively, magnetic particle-depleted flow volumes.

2. A high gradient magnetic separator according to claim 1, wherein said channels have a circular cross-section.

3. A high gradient magnetic separator according to claim 1, wherein said channels have an oval cross-section.

4. A high gradient magnetic separator according to claim 1, wherein said matrix is formed by a block of non-magnetic material, which is provided with bores receiving said sets of wires and bores forming said channels.

5. A high gradient magnetic separator according to claim 1, wherein said matrix is composed of molded components which are assembled to form passages receiving said sets of wires and defining said channels.

6. A high gradient magnetic separator according to claim 1, wherein the partial flow channels of said magnetic particle-depleted fluid flow are in communication with collection channels extending out of the high gradient magnetic separator.

7. A high gradient magnetic separator according to claim 1, wherein said partial flow channels of said magnetic particle-enriched fluid flow extend to a collector space provided with an outlet for the discharge of the particle-enriched fluid flow.

8. A high gradient magnetic separator according to claim 1, wherein the partial flow channels of the magnetic particle-depleted partial fluid flow extend to a common solution collection space provided with an outlet for the discharge of the particle-depleted fluid flow.

9. A high gradient magnetic separator according to claim 1, wherein said wires consist of a hard magnetic material which can be permanently magnetized by exposure to a magnetic field.

* * * * *